United States Patent [19]

Cook, Sr.

[11] 4,128,139

[45] Dec. 5, 1978

[54] AUTOMATIC LEVELLING AND LOCKING LADDER

[76] Inventor: Jack E. Cook, Sr., 217 Cassandra Bldg. Apt. 1111, Don Mills, Ontario, Canada

[21] Appl. No.: 858,297

[22] Filed: Dec. 7, 1977

[51] Int. Cl.[2] ..... E06C 7/44

[52] U.S. Cl. ..... 182/202; 248/188.3

[58] Field of Search ..... 182/202, 201, 200, 203, 182/204, 205; 248/188.2, 188.3, 188.5, 188.8

[56] References Cited

U.S. PATENT DOCUMENTS

| | | | |
|---|---|---|---|
| 2,451,113 | 10/1948 | Ozols | 182/202 |
| 2,894,670 | 7/1959 | Anderson | 182/202 |
| 3,805,917 | 4/1974 | Luther | 182/200 |
| 3,878,918 | 4/1975 | Basile | 182/202 |

FOREIGN PATENT DOCUMENTS

| | | | |
|---|---|---|---|
| 342693 | 8/1936 | Italy | 182/202 |

*Primary Examiner*—Reinaldo P. Machado
*Attorney, Agent, or Firm*—Kenneth M. Garrett

[57] ABSTRACT

In a self levelling ladder base of the type wherein each leg of the base has a rack and pinion assembly, the pinions being interconnected by a shaft, and a tab interfering with the pinions to prevent their rotation as weight is placed on the ladder, automatic locking means are provided to retain the tab in interfering engagement subsequent to the weight being removed, thereby increasing the operational safety of the ladder.

10 Claims, 5 Drawing Figures

Figure 2:
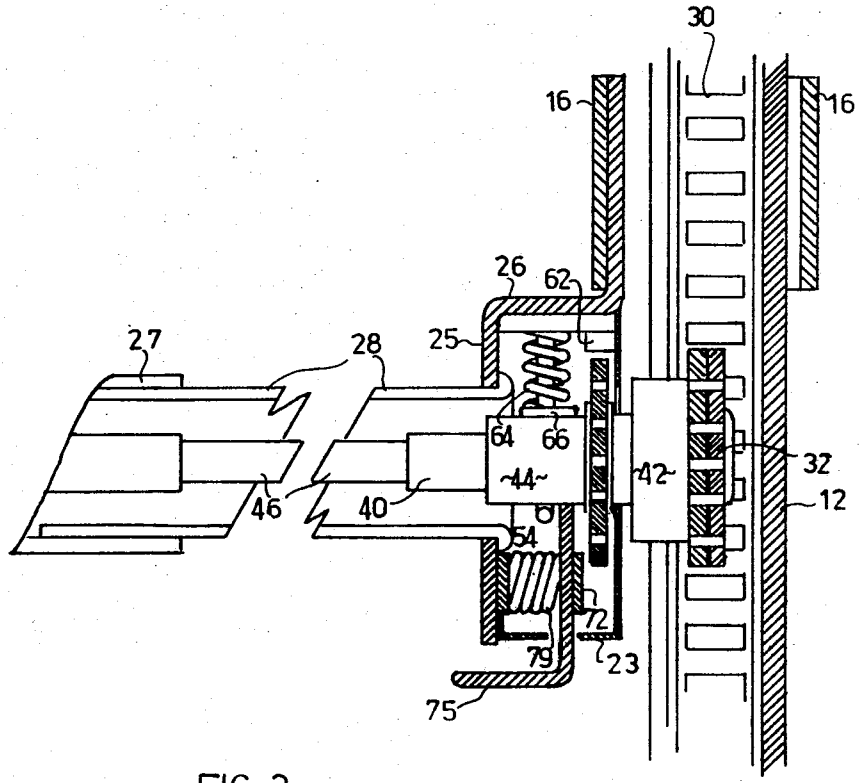

40
60
78
14
62
44
72
75
25
32
42
29
23
64
66
54
76
77
74
79
24
28
26

AUTOMATIC LEVELLING AND LOCKING LADDER

This invention relates to self levelling ladders. It particularly relates to improvements in the automatic levelling and locking mechanism of such ladders.

In U.S. Pat. No. 2,894,670 to Anderson et al a self levelling ladder was shown as comprising a pair of hollow leg members which slidably secure to the rails of a ladder on each side thereof. Within each leg member is mounted a rack gear in general alignment with the leg, and a pinion meshing with the rack. The two pinions are rigidly secured to rotatable shaft spanning between the opposed leg members. Movement of a one leg member in a one direction is transmitted via the pinions and shaft to drive the other leg member an equal distance in the opposed direction. The mechanism further comprises a tab member located within each of the hollow leg members and spring biased to a position above the respective pinions. As weight is applied to a rung member of the ladder, the spring bias is overcome so as to force the tab members into engagement with the respective pinions and thereby inactivate the rotatable shaft. The engagement is maintained only so long as weight is placed on the ladder. Manual means for inactivating the levelling mechanism was further described by the patentee for the purpose of transporting the ladder.

The present invention contemplates improvements to the adjusting mechanism described. In one respect my invention comprises the provision of a mechanism which automatically locks the pinions as a weight is placed on the ladder and which remains locked even after weight is removed from the ladder, so as to improve the safety thereof.

In a further aspect my invention comprises improvements whereby the adjusting and locking mechanism is more fully protected from the ingress of debris and other foreign materials encountered commonly when using the ladder.

In one form my invention comprises a self levelling ladder base including a pair of hollow, elongated legs, and a suitable means for clamping these to the rails of a ladder so as to be slidable therealong. Each leg has a rack and pinion, the pinions being coupled by a shaft. The shaft assembly is rotatably mounted within a housing rigidly attached to the legs and from which, in turn, the rails of the ladder are supported. The housing is moveable in a generally vertical direction relative to the shaft and is urged upwardly by a first biasing means. Depending from the housing is a tab means which, when a weight is placed on the ladder so as to overcome the first bias means and move the housing downwardly with respect to the shaft, interferes with the shaft assembly (which in taken to include the pinions) so as to prevent rotation thereof, and any consequent movement of the legs of the base. A locking means is mounted within said housing. The locking means is moveable between first and second positions and second biasing means is provided to urge the locking means towards the second position. A latching means is further provided which retains the locking means in its first position until such time as a weight is placed on the ladder and the first bias means is overcome. As this first bias is overcome, the latching means releases the locking means which, under the influence of the second bias means, is urged to its second position wherein it is interposed between the shaft and the housing so as to prevent the return of the housing under the action of the first bias means even subsequent to weight being removed from the ladder, whereby the tab is retained in interfering position. Means for resetting the latching means is further provided.

In other preferred aspects of my invention the shaft carries a second pair of pinions inwardly located with respect to the first pair. The second pinions are external of the hollow leg members but adjacent thereto. The aforementioned tab members are located within the housing so as to interfere respectively with the second pair of pinions. Automatic locking means are further located within the housing. Shutter means is located between the respective legs and the housing so as to effectively seal the housing and the mechanism contained therein.

Figure 1:
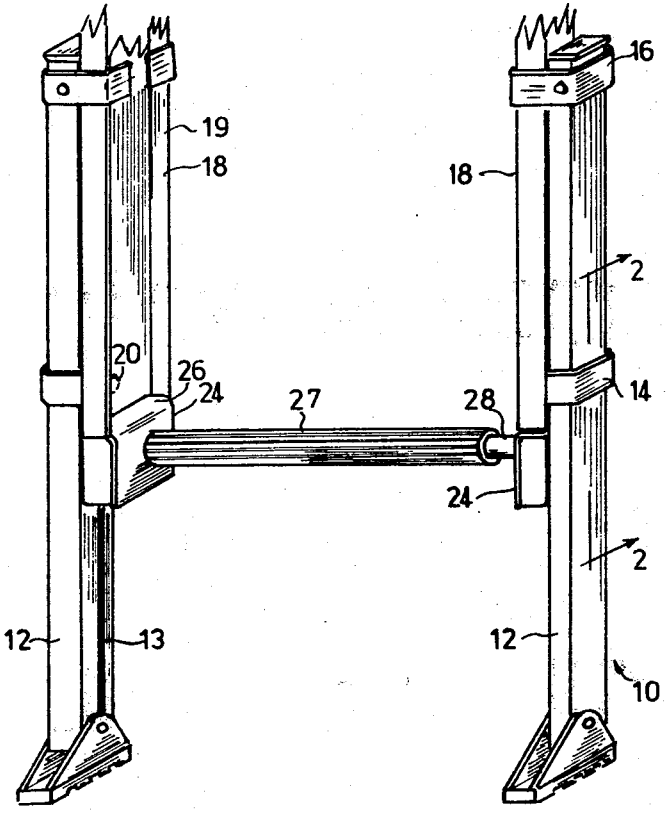

My invention will be further described in relation to preferred embodiments thereof as illustrated in the accompanying drawing wherein FIG. 1 shows in perspective view a ladder to which my ladder base is connected FIG. 2 shows a cross section along line 2—2 of FIG. 1

Figures 3, 4, 5:
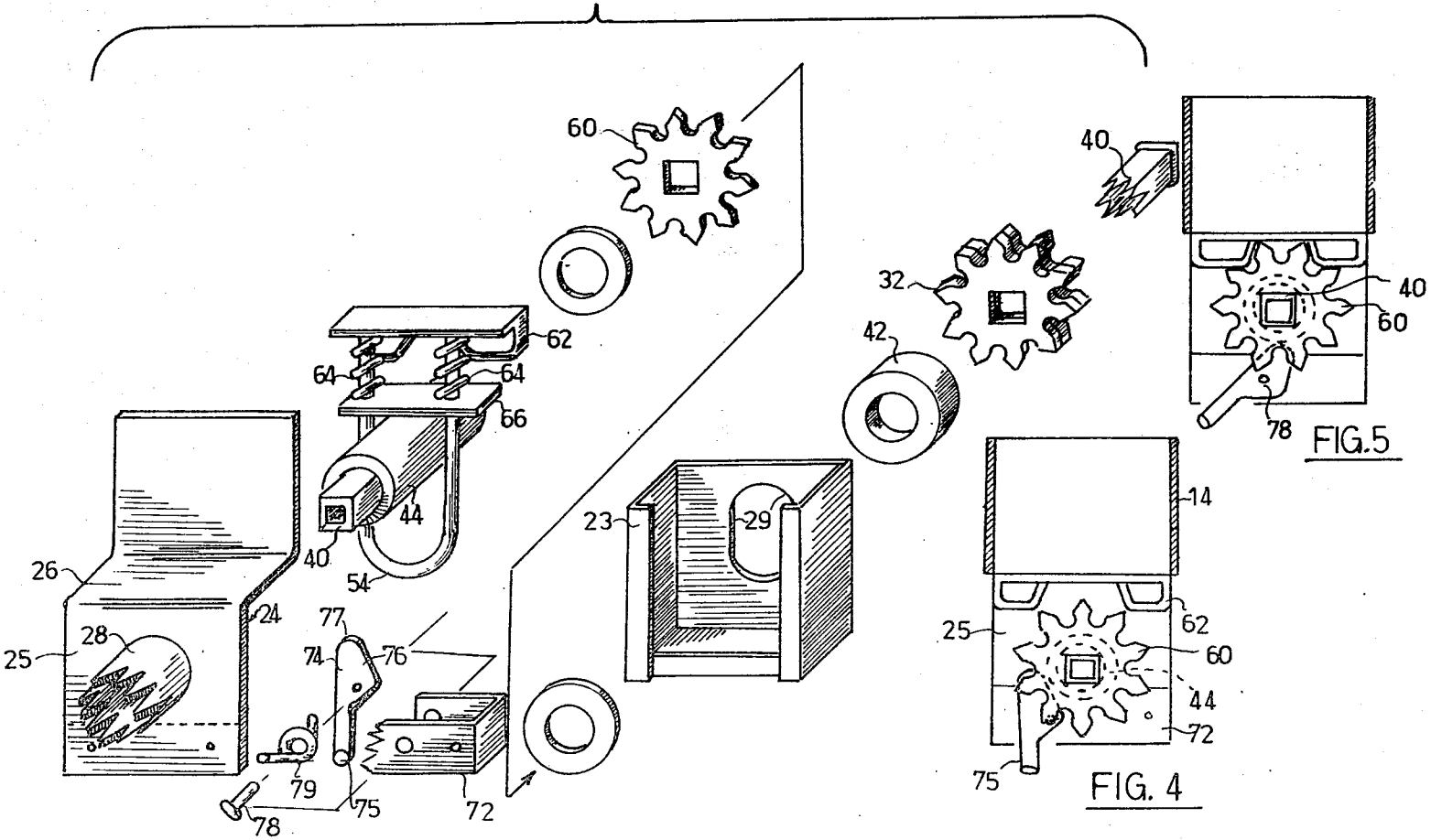

FIG. 3 shows in exploded, perspective view details of the latch-lock of FIG. 2

FIGS. 4 and 5 show the latch-lock in elevation in unlocked and locked positions respectively Referring to the Figures in detail, a ladder base is denoted generally by the numeral 10. Except as is otherwise specifically stated, the left hand side of ladder base 10 is identical to the right hand side, although turned through 180°; only the one side of the ladder base is therefore detailed. Ladder base 10 comprises a pair of hollow elongated legs 12 and first bracket means 14 which is securable to the bottom portions of the rails 18 of a ladder 19, for example with bolts 20, and second bracket means 16 which is securable either to legs 12 or to rails 18, so as to permit legs 12 to be slideable along rails 18. A housing 24 is secured to lower bracket 14; the housing has a horizontal step portion 26 upon which the foot of ladder rail 18 rests so as to be supported therefrom. Opposed housing portions are interconnected by tubular rung members 27, 28, the one being telescopically slidable with the other so that ladder base 10 may be adjusted to fit various sizes of ladders.

Referring now to FIGS. 2 and 3, within each hollow leg 12 is mounted an elongated rack gear 30, and a first spur gear pinion 32 in mesh therewith. Spur gear 32 is preferably formed from laminated steel, and is rigidly mounted on a square shaft 40. Hollow leg 12 has an elongated slot opening 13 in the inwardly facing surface thereof to permit the passage of shaft 40 therethrough, and also a relatively large washer 42 which is mounted on shaft 40, the purpose of which is to be later described. Shaft 40 is mounted from housing 24 for rotary movement by a U shackle 52 which is secured to the underside of step 26. A tubular bushing 44 of circular section circumscribes shaft 40 where it passes through the bight 54 of U shackle 52. Referring specifically to FIG. 2, the shaft of the left hand side assembly is denoted as **40*a* and is somewhat longer than that of the right hand side assembly. The two shaft portions, 40, 40*a* are tubular, and are interconnected by a square rod 46 which telescopes within the hollow shaft in order that the width of the ladder base may be adjusted as previously mentioned. Of course such a feature is entirely optional. The assembly thus far depicted functions essentially as described in the prior art. Assuming a ladder 19 and base assembly 10 combination to be placed on a ground surface such that only the right leg of base 10 makes contact with the ground surface when in a vertical position, when a downward pressure is exerted on ladder 19, the righthand ladder rail 18 is caused to slide downwardly on the righthand leg 12 of base 10. This sliding movement will be translated by the rack 30 and spur gear pinion 32 in the righthand leg assembly to a rotary movement, and transmitted to the left hand leg assembly by shafts 40, 40***a* and connecting rod 46 to cause the left hand leg 12 to slide downwardly on left hand rail 18 until that leg bears upon the ground surface. In such condition the combination will be referred to as levelled.

Housing 24 comprises a generally Z shaped metal plate portion of substantial strength which includes central step portion 26 previously defined and a downwardly directed flange 25 to which rung member 28 is rigidly secured (rung member 27 being similarly secured to the corresponding flange 25 of the left hand side assembly). The housing 24 is completed by a cover 23, which maybe of light gauge material, and which substantially encloses a space between flange 25 and the inwardly facing wall of leg 12. Cover 23 has an elongated opening 29 therein in register with slot opening 13 to permit the passage of shaft 40 there through. Washer 42 has an outside diameter somewhat larger than the width of opening 29, and forms a shutter to substantially seal the opening, thereby preventing the ingress into housing 24 of debris and foreign matter such as may commonly be encountered when the ladder base is in use.

Within the closed confines of housing 24 are located a means for blocking the rotation of shaft 40. This blocking means comprises a second spur gear 60 rigidly attached to shaft 40, and inwardly spaced from pinion 32. Superior to gear 60 and generally in the plane thereof is located a bracket 62 which may conveniently be folded from sheet steel. As best seen in FIG. 5, bracket 62 has downwardly depending tab portions which complement and contact portions of at least four teeth of spur gear 60 when in blocking cooperation therewith. The legs of U shackle 52 are secured to bracket 62; a helical compression spring 64 is captive on each leg. A plate 66 and compression springs 64 are captive on shackle 52, the plate bearing on bushing 44, the springs thus forming a biasing means for urging housing 24 and blocking bracket 62 upwardly so as not to interfere with the rotational movement of shaft 40. When a weight is placed on a rung of the ladder assembly, the biasing means is overcome and spur gear 60 will be blocked by bracket 62, thereby preventing rotation of shaft 40.

Referring now to the latching and locking portion of my invention, there is further mounted within housing 24 a small sub-assembly 70 comprising a U shaped frame 72, bent from flat metal stock, a lock-lever 74 mounted for rotary movement in frame 72 by rivet 78, and coil spring 79 which urges lock-lever 74 to rotate in a clockwise direction, as seen in FIGS. 3–5. Frame 72 of sub-assembly 70 is in turn rigidly secured to the surface of flange 25 which faces into housing 24. Lock-lever 74 comprises an elongated downwardly depending handle portion 75, which projects from beneath housing 24, and an upwardly depending head portion 76. With reference to FIG. 4, when gear 60 is not engaged by blocking bracket 62 (which condition will generally obtain when there is no weight placed on the ladder assembly) head portion 76 of lever 74 bears against bushing 44, which thus prevents rotation of the lever under the action of spring bias 79. When a weight is placed on a rung of the ladder assembly, bias springs 64 will be compressed when the ladder is levelled, and housing 24, including flange 25, will move downwardly in relation to gear 60 so as to block the latter. Head portion 76 of lever 74 is proportioned so that when blocking bracket 62 engages gear 60, as in FIG. 5, the crown 77 of the lever just passes beneath bushing 44. It may be seen that shaft 40 and bushing 44 comprise a latch for lever 74, permitting its passage into a locking position only when biasing springs 64 are compressed and gear 60 consequently blocked. Further clockwise rotation of lever 74 is prevented by handle portion 75 bearing against flange 25. When in this position, the crown 76 of lever 74 locates centrally beneath bushing 44 to lock the same so as to prevent the upward movement of housing 25 relative to gear 60 under the influence of bias springs 64, which would normally occur when weight is removed from the ladder assembly. Note that sub-assembly 70 may be of relatively light construction, as it is not this sub-assembly which takes the weight of a person using the ladder combination. It will be appreciated that the locking action is entirely automatic, and that the lock will remain engaged even when weight is removed from the ladder assembly. To disengage the lock it is only required to rotate handle 75 in an anti-clockwise direction, against the influence of biasing spring 79. The head portion 76 of lever 74 is rearwardly upwardly sloping in a cam portion, and as housing 24 is urged upwardly by springs 64, this cammed portion will ride on bushing 44, thus causing lever 74 to move anti-clockwise so as to return it to the latched position shown in FIG. 4.

Whilst my invention has been described in respect to a preferred illustrated embodiment thereof, it will be apparent that it may be embodied in equivalent structures. The scope of the invention is therefore to be constructed in accordance with the spirit of the accompanying claims.

I claim:

1. In a self levelling base structure for use in combination with a ladder, said ladder comprising a pair of ladder rails, said base structure including a pair of parallel, spaced apart upstanding leg members, means for mounting said leg members for vertical sliding movement relative to said rails, each said leg member being provided with a rack member, a pinion member engaging each said rack member, said pinions being coupled by shaft means, a housing for said shaft means, means for rotatably supporting said shaft means within said housing, the last said means permitting generally vertical relative movement between said shaft means and said housing, first bias means urging said housing upwardly relative to said shaft means, and blocking means engageable with said shaft means to restrict rotary movement thereof when said housing moves downwardly towards said shaft means in opposition to said first bias means, the improvement wherein automatic locking means is provided for restricting upward movement of said housing relative to said shaft means, said locking means comprising a locking member mounted within said housing for movement between a first position permitting relative vertical movement between said housing and said shaft means and a second position interposed between said housing and said shaft means to restrict said relative vertical movement, a second bias means urging said locking member to said second position, latching means associated with said shaft means and said housing permitting movement of said locking member to said second position as said housing moves downwardly relative to said shaft means, and means for returning said locking means to said first position.

2. The ladder base of claim 1 wherein said locking means is pivotally mounted from said housing.

3. The ladder base of claim 2 wherein said latching means comprises said shaft means.

4. The ladder base of claim 3 wherein said returning means comprises an elongated portion of said locking means, said portion projecting outwardly from said housing.

5. The ladder base of claim 1 wherein said blocking means comprises a pair of gear members rigidly mounted on said shaft member and inwardly spaced from respective said pinion members.

6. The ladder base of claim 5 wherein said blocking means further comprises a pair of bracket members secured to said housing, said bracket members being shaped to contact portions of four adjacent teeth of respective said gear members.

7. The ladder base of claim 5 wherein shutter means is interposed between each said leg and said housing, said shutter means combining with said housing to essentially enclose said blocking means.

8. The ladder base of claim 1 wherein said locking member is provided with a cammed head portion which bears on said shaft means as said housing moves upwardly relative to said shaft, thereby causing said blocking member to return to a latched position.

9. The ladder base of claim 1 wherein said means for supporting said shaft means comprises a U-shaped shackle, and wherein said first bias means comprises a compression spring captive on a leg of said shackle.

10. The ladder base of claim 1 in combination with a ladder.

* * * * *